US005615973A

United States Patent [19]

Campbell

[11] Patent Number: 5,615,973

[45] Date of Patent: Apr. 1, 1997

[54] PAVING MACHINE WITH GRAVITY FEED HOPPER AND AUGER MECHANISM

[75] Inventor: Thomas R. Campbell, Chatanooga, Tenn.

[73] Assignee: Astec Industries, Inc., Chattanooga, Tenn.

[21] Appl. No.: 314,348

[22] Filed: Sep. 29, 1994

[51] Int. Cl.[6] ..... E01C 19/12

[52] U.S. Cl. ..... 404/75; 404/108; 404/110

[58] Field of Search ..... 404/101, 102, 404/108, 110, 114, 75

[56] References Cited

U.S. PATENT DOCUMENTS

| | | | |
|---|---|---|---|
| 1,994,812 | 3/1935 | Deicke | 404/108 |
| 3,453,939 | 7/1969 | Pollitz et al. | 94/46 |
| 3,699,855 | 10/1972 | Leister | 94/46 |
| 3,884,395 | 5/1975 | Keenan | 404/108 X |
| 3,907,451 | 9/1975 | Fisher et al. | 404/101 |
| 4,708,519 | 11/1987 | Davin et al. | 404/101 |
| 4,765,772 | 8/1988 | Benedetti et al. | 404/101 X |
| 4,818,139 | 4/1989 | Brock et al. | 404/81 |
| 4,978,068 | 12/1990 | Eldridge | 239/129 |
| 5,269,626 | 12/1993 | Soliman et al. | 404/108 |

FOREIGN PATENT DOCUMENTS

| | | | |
|---|---|---|---|
| 1569361 | 6/1990 | U.S.S.R. | 404/101 |

OTHER PUBLICATIONS

Roadtec, an Astec Company; *Roadtec RP 180* Bulletin.

*Primary Examiner*—James A. Lisehora
*Attorney, Agent, or Firm*—Nilles & Nilles, S.C.

[57] ABSTRACT

A paving machine has a gravity feed hopper which is capable of delivering by gravity to the paving apparatus substantially all of the paving materials stored in the hopper without employing any internal conveyors. The discharge opening of the hopper is selectively closed by a feeder gate, the degree of opening of which is preferably coordinated with other operating parameters of the machine such as vehicle speed, distributing auger height and/or speed, and screed operation. Use of the gravity feed hopper significantly reduces construction and maintenance costs, provides a more uniform feed of materials from the hopper, and permits the use of a smaller engine. The paving machine as thus constructed is also relatively easy to operate and thus can be controlled by a single operator seated in the vicinity of the screed.

17 Claims, 2 Drawing Sheets

PAVING MACHINE WITH GRAVITY FEED HOPPER AND AUGER MECHANISM

BACKGROUND OF THE INVENTION

1. Field of the Invention

The invention relates to paving machines and, more particularly, relates to pavers of the type having a distributing auger, a screed, and a hopper for storing hot mix asphalt (HMA) or other paving materials and for delivering the paving materials to the distributing auger and screed.

2. Discussion of the Related Art

Floating screed-type paving machines are well known for the laying of HMA on roadways. Such machines typically include a self-propelled tractor-like vehicle having an engine for propulsion and for material distributing functions; a hopper provided at the front of the machine; a distributing auger mechanism provided at the rear of the machine; and a heated vibratory screed provided behind the distributing auger. The hopper, typically having a capacity of about 12 tons, is relatively low and extends all the way to the front of the paving machine so as to be capable of receiving HMA directly from a truck positioned in front of and pushed by the paving machine as the paving machine travels along the roadway. Hoppers of this type are incapable of feeding HMA by gravity to the distributing auger mechanism and thus require an internal conveyor mechanism to convey materials from the front of the hopper to a rear discharge opening located adjacent the distributing auger mechanism. This conveyor mechanism typically takes the form of a pair of parallel drag slat conveyors extending longitudinally of the hopper and communicating with independently operable feeder gate mechanisms located at the discharge opening.

Paving machines with hoppers having internal conveyors, though operationally adequate, exhibit several drawbacks and disadvantages. For instance, the drag slat conveyors typically used to convey aggregate in the hopper towards the rear discharge opening are relatively expensive to install and maintain and, indeed, are typically the most expensive part of the paving machine to maintain. It is also relatively difficult to maintain a uniform discharge of materials from the hopper using such conveyors, particularly when the hopper is nearly empty during which time less or even no materials are delivered to the discharge opening between the times at which successive flights of the conveyors reach the openings. Substantial hand work is required at the end of the mat to compensate for this deficiency and to deliver to the discharge openings any materials which are inaccessible by the conveyors. The problem of uneven feed of materials from the hopper can be partially alleviated by permitting the speeds of the parallel drag slat conveyors to be independently controlled by the operator(s) as disclosed in U.S. Pat. No. 3,453,939 to Pollitz et al. Such a control system, however, necessarily increases further the cost and complexity of the paving machine and also places additional burdens on the operators.

Moreover, a relatively large engine is required because 1) the paving machine must push the truck along the roadway as the truck delivers materials to the hopper, and 2) significant power is required to operate the conveyors in the hopper.

OBJECTS AND SUMMARY OF THE INVENTION

It is therefore an object of the invention to provide a paving machine which is relatively inexpensive to build and maintain and which requires less power than paving machines which were heretofore available.

Another object of the invention is to provide a paving machine which is simple to operate and which preferably can be controlled by a single operator.

Yet another object of the invention is to provide a paving machine which exhibits one or more of the characteristics discussed above which is capable of providing a uniform flow of paving materials to the discharge opening of the hopper at all times.

In accordance with a first aspect of the invention, these objects are achieved by providing a paving machine comprising a portable chassis, a paving apparatus mounted on the chassis, and a gravity feed hopper which (1) is mounted on the chassis, (2) stores paving materials, and (3) is dimensioned and configured so as to deliver substantially all paving materials stored therein to the paving apparatus by gravity without utilizing any internal conveyors. The hopper preferably includes an upper storage portion and a lower discharge portion which (1) has a discharge opening formed in a bottom end thereof and (2) in use directs paving materials from the storage portion to the discharge opening. A feeder gate is arranged to selectively close the discharge opening.

In order to simplify operation of the paving machine, a drive device, preferably comprising one or more hydraulic cylinders, is actuatable to selectively open and close the gate and is controlled to adjust an opening degree of the gate in response to a designated operational state of at least one of the screed and the auger.

The simplicity of the machine permits all manual controls to be performed by a single operator seated at an operator's console located in the vicinity of the screed.

Still another object of the invention is to provide a simple, inexpensive, and yet reliable method of uniformly feeding materials to the screed assembly of a paving machine.

In accordance with another aspect of the invention, this object is achieved by providing a paving machine having a movable chassis and having a hopper and a paving apparatus mounted on the chassis; storing paving materials in the hopper; and then feeding substantially all of the stored paving materials by gravity through a discharge opening of the hopper without employing any conveyors.

The method preferably further includes adjusting a rate of paving material discharge from the discharge opening of the hopper in dependence on at least one of (1) the speed of the paving machine and (2) the operational state of at least one of (i) the auger and (ii) the screed.

These and other objects, features, and advantages of the invention will become more readily apparent to those skilled in the an from the following detailed description and the accompanying drawings. It should be understood, however, that the detailed description and specific examples, while indicating preferred embodiments of the present invention, are given by way of illustration and not of limitation. Many changes and modifications within the scope of the present invention may be made without departing from the spirit and scope thereof, and the invention includes all such modifications.

BRIEF DESCRIPTION OF THE DRAWINGS

A preferred exemplary embodiment of the invention is illustrated in the accompanying drawings in which like referenced numerals represent like parts throughout, and in which.

DETAILED DESCRIPTION OF THE PREFERRED EMBODIMENT

1. Resume

Figure 1:
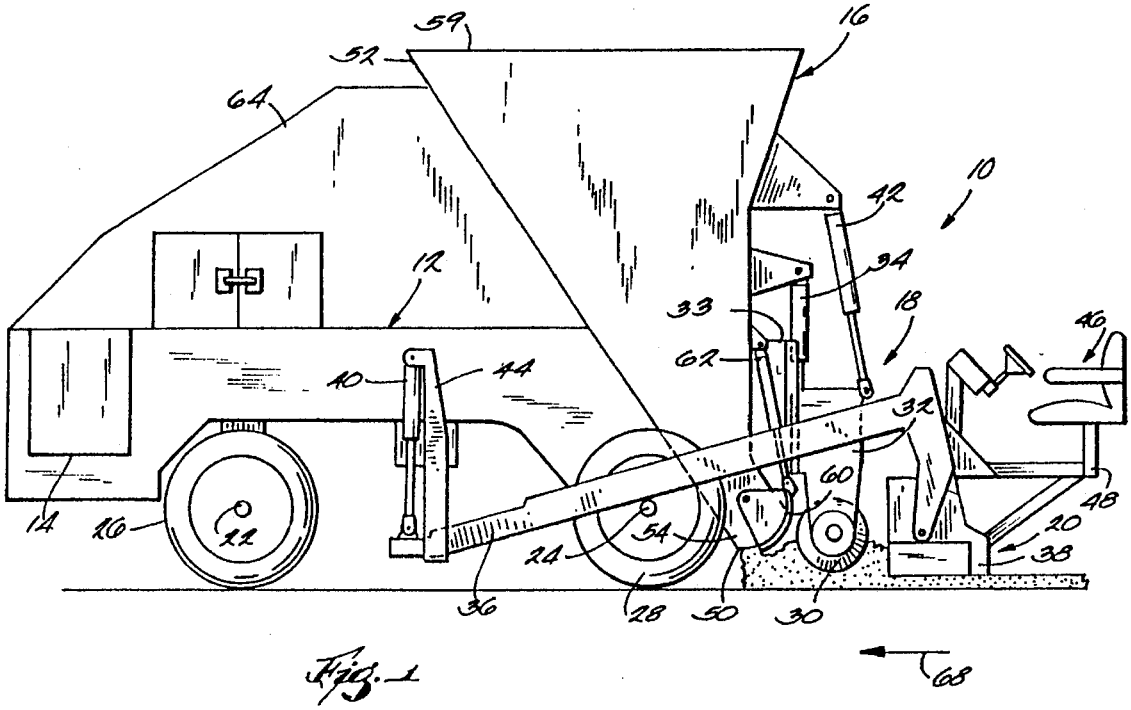
FIG. 1 is a side-elevation view of a paving machine constructed in accordance with a preferred embodiment of the present invention.
Figure 2:
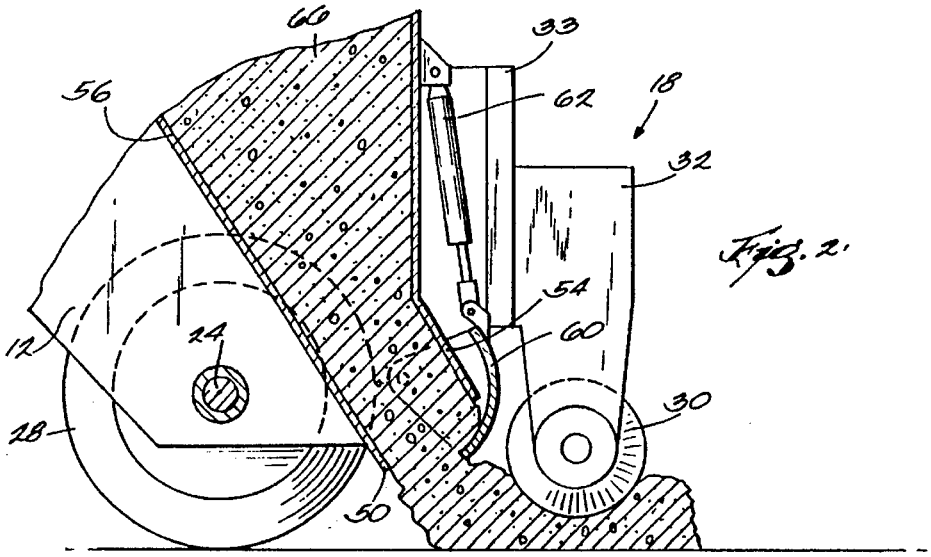
FIG. 2 is a side-sectional-elevation view of a portion of the machine illustrated in FIG. 1 with the screed assembly removed.
Figure 3:
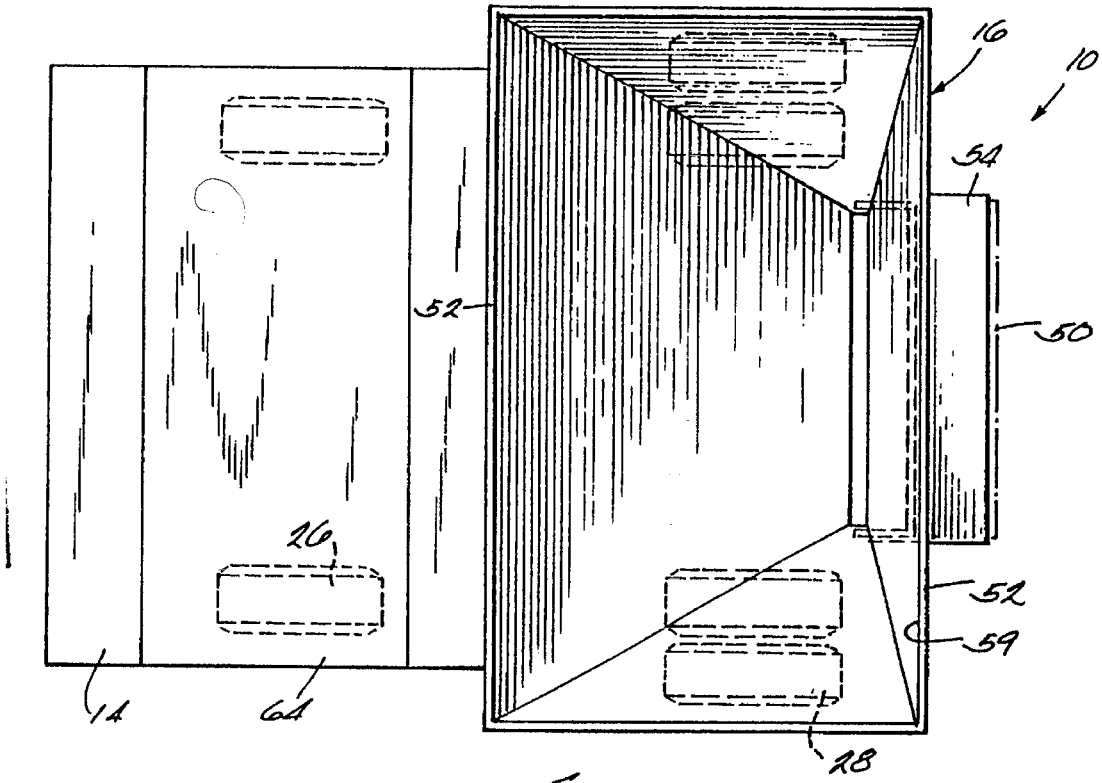
FIG. 3 is a top-plan view of the paving machine of FIG. 1 with the distributing auger mechanism and screed assembly removed.
Figure 4:
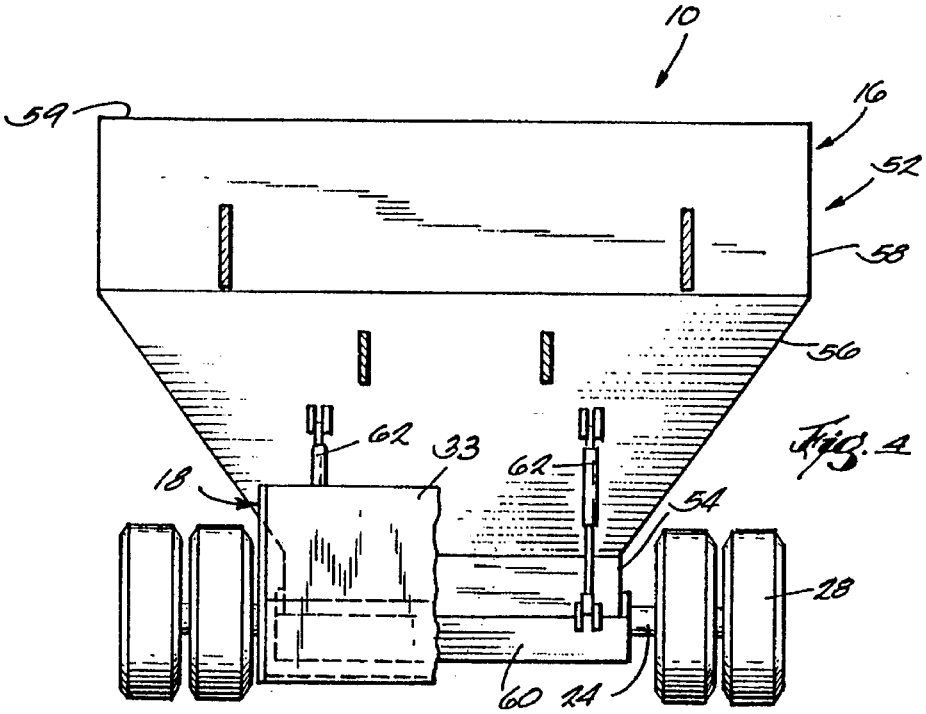
FIG. 4 is a partially cut-away rear-elevation view of the paving machine of FIGS. 1–3 with the distributing auger mechanism and screed assembly removed.

Pursuant to the invention, a paving machine is provided having a gravity feed hopper which is capable of delivering substantially all of the paving materials stored therein by gravity to the paving apparatus without employing any internal conveyors. The discharge opening of the hopper is selectively closed by a feeder gate, the degree of opening of which is preferably coordinated with other operating parameters of the machine such as vehicle speed, distributing auger height and/or speed, and screed operation. Use of the gravity feed hopper significantly reduces construction and maintenance costs, provides a more uniform feed of materials from the hopper, and permits the use of a smaller engine. The paving machine as thus constructed is also relatively easy to operate and thus can if desired be controlled by a single operator seated in the vicinity of the screed.

2. Construction of Paving Machine

Referring now to the drawings, a paving machine 10 constructed in accordance with a preferred embodiment of the invention is illustrated and includes a self-propelled chassis 12 on which is mounted from front to rear an engine 14, a hopper 16, and a paving apparatus including (1) a distributing auger mechanism 18 and (2) a screed assembly 20. The chassis 12 is mounted on front and rear axles 22 and 24 receiving front steering and rear driving wheels 26 and 28, respectively. The front and rear axles 22 and 24 are steered and powered hydrostatically by engine 14 in a known manner.

Screed assembly 20 and auger mechanism 18 may be any conventional mechanisms and, in the illustrated embodiment, are of the type employed by the paving machine manufactured by Roadtec of Chattanooga, Tenn. under the Model No. RP-180. The auger mechanism 18 thus includes a hydrostatically driven screw auger 30 extending transversely across the paving machine 10 and mounted on a slide 32 which is raiseable and lowerable with respect to a stationary frame 33 via operation of hydraulic cylinders 34. The screed assembly 20 comprises 1) a pair of transversely opposed tow arms 36 (only one of which is illustrated) and 2) a heated vibratory screed 38 pivotably suspended from the rear ends of the tow arms 36. Each tow arm 36 is raiseable and lowerable with respect to the chassis 12 at its front end via a first hydraulic cylinder 40 and at its rear end via a second hydraulic cylinder 42. The front end of each of the tow arms 36 is also pivotally connected to the chassis 12 at a tow point, formed from a suspended bracket assembly 44, so as to permit vertical adjustment of the screed assembly 20 using the cylinders 40 and/or 42.

It should be noted that, in typical paving machines heretofore available, the paving material feed and delivery devices (including the hopper conveyors and distributing auger mechanism) and screed were controlled by separate operators positioned on the paving machine chassis and screed, respectively. It is also not unusual in such machines to have dual stations on the paving machine to permit the machine to be operated from either lateral side with the active operator station being determined by the instantaneous operating conditions of the machine. However, because the paving machine 10 is considerably simplified compared to typical paving machines, it is possible to perform all manual control operations required to run both the entire machine 10 including the screed assembly 20 from a single operator's station or console 46 mounted on a support platform 48 which is in turn mounted on the screed 38. Although the operator's station or console 46 is illustrated as being fixed in position, this station could if desired be mounted on a carriage which is movable transversely across the platform 48 thereby permitting the operator to run the machine 10 from either side of the screed assembly 20 without requiring the dual consoles employed by many paving machines which were heretofore available. Console 46 can also be installed on the rear of the hopper 16 in lieu of the screed 38.

The hopper 16 preferably has a total capacity of about 12 tons to conform with industry standards and is designed to feed-by gravity to a discharge opening 50 thereof all of the paving materials stored therein without employing any internal conveyors. To this end, the hopper 16 includes an upper storage portion 52 and a lower discharge portion 54. The storage portion 52 has at least a lower generally frusto-conical section 56 having an upper end of enlarged cross section and having a lower end of reduced cross section connected to an upper end of the discharge portion 54. (The term "frusto-conical" as used herein is not meant to require a square cone but instead denotes any structure the cross section of which decreases substantially continuously from an upper end to a lower end thereof). An upper section 58 of storage portion 52 is preferably provided above the lower section 56 to increase the capacity of the hopper 16 and, in the illustrated embodiment, is of a relatively constant width and terminates at an open top 59. Discharge portion 54 has the discharge opening 50 formed in the bottom end thereof and in use directs paving materials from the storage portion 52 to the discharge opening 50. The discharge portion 54 is also inclined downwardly and rearwardly towards the distributing auger mechanism 18 so as to direct paving materials towards the top of the auger mechanism 18 without the aid of any external conveyors. The transverse length of the discharge opening 50 is preferably roughly the same as the length of the distributing basic auger mechanism 18 so as to promote uniform material feed to all portions of the auger mechanism 18.

The discharge opening 50 in the hopper 16 is selectively closeable by a feeder gate 60 which, in the illustrated embodiment, takes the form of a clam shell gate opened and closed by a drive device. The drive device may comprise a screw jack or the like but preferably comprises at least one and even more preferably a pair of hydraulic cylinders 62 suspended from the outer wall of the storage portion 52 and connected to respective end portions of the gate 60.

The hopper 16 is preferably located at the rear of the paving machine 10 to obviate the need for any conveyors to deliver materials to the distributing auger mechanism 18 after they are discharged from the hopper. The thus located hopper 16 may however, when fully loaded, tend to overload the back end of the paving machine 10 so as to destabilize the machine 10. This potential problem is overcome by locating the engine 14 and the heavy frame steel components near the front of the chassis 12 and preferably in front of the front axle 22 as illustrated, thereby providing sufficient weight at the front of the machine 10 to counteract any destabilizing effect caused by mounting the hopper 16 at the rear of the machine 10. This construction results in a substantial space between the engine 14 and the hopper 16 which may be left open or may be enclosed as illustrated to form a storage compartment 64 or the like.

3. Operation of Paving Machine

In use, the paving machine 10 is readied for operation by positioning it on the roadway surface to be paved and by filling the hopper 16 with paving materials 66. The paving materials 66 could be any of various known materials but will usually comprise HMA and will henceforth be referred to as HMA for the sake of convenience. The hopper 16 is filled by conveying HMA 66 through the open top 59 using either a separate conveyor or a shuttling apparatus such as that disclosed in U.S. Pat. No. 4,818,139 to Brock et al. (such an apparatus is required because the hopper 16 is too high to be accessed directly by a truck). The sloping side of hopper 16 is preferably heated at this time by engine exhaust or another suitable heat source in order to maintain good flow of HMA to the screed.

The operator, seated at station or console 46, then controls the engine 14 to propel the paving machine 10 in the direction of the arrow 68 in FIG. 1. Paving is then commenced by discharging HMA from the discharge opening 50 of the hopper 16, then distributing the thus discharged HMA using the distributing auger mechanism 18, and then working the HMA into a mat using the screed assembly 20. HMA continues to flow by gravity out of the hopper 16 at a substantially uniform rate (assuming a constant operational state of the feeder gate 60) until the hopper 16 is completely or nearly completely empty. This obviates the need for independent controls of internal conveyors to promote a uniform feed of HMA because it delivers HMA uniformly even when the hopper 16 is nearly empty. Less manual labor is required at the end of the mat than is required by hoppers which employ internal drag slat conveyors because of superior control of material flow. The rate of HMA delivery from the hopper 16 can, however, be adjusted to accommodate changes in vehicle speed and/or in auger and/or screed operation simply by actuating the cylinders 62 to change the position of the feeder gate 60, thus varying the effective cross section of the discharge opening 50. Operation of the cylinders 62 could be controlled manually based on visual observation of at least one of (1) machine speed and (2) the operating conditions of the screed assembly 20 and/or distributing auger mechanism 18 or, in a more sophisticated embodiment, could be controlled automatically based upon sensed operating parameters. The control of HMA discharge using a single feeder gate 60 considerably simplifies paving machine operation and contributes to the ability to control the entire paving machine 10 using a single operator stationed at console 46.

Many changes and modifications may be made to the present invention without departing from the spirit thereof. For instance, the hopper need not be employed in a paving machine having a distributing auger mechanism and screed assembly of the disclosed type and, as discussed above, could be employed to store and discharge paving materials other than HMA. The scope of these and other changes will become apparent from the appended claims.

I claim:

1. A paving apparatus, comprising:

a gravity feed hopper for holding paving materials, said gravity feed hopper having a capacity and including a discharge opening for discharging paving materials, said discharge opening having a first transverse length;

a storage portion for storing paving materials, said storage portion including i) an upper section for increasing the capacity of said hopper, said upper section having a relatively constant width and terminating at an open top; and ii) a lower generally frusto-conical section having an upper end of enlarged cross section and a lower end of reduced cross section, said upper end of enlarged cross section being connected to said upper section; and a discharge portion for directing paving materials from said storage portion to said discharge opening, said discharge portion having a second transverse length, a discharge portion upper end connected to said lower end of reduced cross section and a bottom end in which said discharge opening is formed;

a feeder gate for selectively closing said discharge opening, said feeder gate being mounted on said discharge portion of said gravity feed hopper; and a vertically adjustable distributing auger mechanism for distributing paving materials, said vertically adjustable distributing auger mechanism being supported by said lower generally frusto-conical of said gravity feed hopper, said vertically adjustable distributing auger having a third transverse length, a top and a screw auger extending transversely across the paving apparatus, said screw auger being mounted on a slide which is raiseable and lowerable with respect to said gravity feed hopper, wherein i) said discharge opening is located between said storage portion and said vertically adjustable distributing auger mechanism and ii) said discharge portion is inclined downwardly and rearwardly towards said vertically adjustable distribution auger mechanism so as to direct paving materials towards said vertically adjustable auger mechanism without the aid of any external conveyors.

2. The paving apparatus of claim 1, wherein said feeder gate is a clam shell gate that is opened by a drive device, said drive device including a pair of hydraulic cylinders that are suspended from an outer wall of said storage portion and connected to respective end portions of said clam shell gate.

3. The paving apparatus of claim 1, wherein said first transverse length is equal to both said second transverse length and said third transverse length.

4. The paving apparatus of claim 1, wherein said discharge portion is inclined downwardly and rearwardly towards said vertically adjustable distribution auger mechanism so as to direct paving materials towards said top of said vertically adjustable auger mechanism without the aid of any external conveyors.

5. The paving apparatus of claim 1, wherein said gravity feed hopper has a capacity of about 12 tons of paving materials.

6. A paving machine, comprising:

a portable chassis i) having a first end and a second end and ii) including a frame;

a front axle that is mounted on said portable chassis, said front axle i) receiving steering wheels and ii) being steered;

an engine mounted on said portable chassis between said first end and said front axle;

a rear axle that is mounted on said portable chassis between said front axle and said second end, said rear axle i) receiving driving wheels and ii) being powered;

a screed assembly mounted on said portable chassis, said screed assembly including i) a pair of transversely opposed tow arms that are mounted on said portable chassis between said front axle and said rear axle and ii) a heated vibratory screed that is pivotably suspended from said pair of transversely opposed tow arms;

a gravity feed hopper for holding paving materials, said gravity feed hopper i) being mounted on said portable chassis, ii) having a capacity and iii) including a discharge opening for discharging paving materials, said discharge opening having a first transverse length;

a storage portion for storing paving materials, said storage portion including an upper section for increasing the capacity of said hopper, said upper section having a relatively constant width and terminating at an open top; and a lower generally frusto-conical section having an upper end of enlarged cross section and a lower end of reduced cross section, said upper end of enlarged cross section being connected to said upper section; and a discharge portion for directing paving materials from said storage portion to said discharge opening, said discharge portion having a second transverse length, a discharge portion upper end connected to said lower end of reduced cross section and a bottom end in which said discharge opening is formed;

a feeder gate for selectively closing said discharge opening, said feeder gate being mounted on said discharge portion of said gravity feed hopper; and a vertically adjustable distributing auger mechanism for distributing paving materials, said vertically adjustable distributing auger mechanism being supported by said lower generally frusto-conical section of said gravity feed hopper and being located between said heated vibratory screed and said gravity feed hopper, said vertically adjustable distributing auger having a third transverse length, a top and a screw auger extending transversely across the paving apparatus, said screw auger being mounted on a slide which is raiseable and lowerable with respect to said frame, wherein i) said discharge opening is located between said storage portion and said vertically adjustable distributing auger mechanism and ii) said discharge portion is inclined downwardly and rearwardly towards said vertically adjustable distributing auger mechanism so as to direct paving materials towards said vertically adjustable auger mechanism without the aid of any external conveyors.

7. The paving machine of claim 6, wherein said feeder gate is a clam shell gate that is opened and closed by a drive device, said drive device including a pair of hydraulic cylinders that are suspended from an outer wall of said storage portion and connected to respective end portions of said clam shell gate.

8. The paving machine of claim 6, wherein said first transverse length is equal to both said second transverse length and said third transverse length.

9. The paving machine of claim 6, further comprising a single operator's console on which is located all manual controls required for operating said paving machine.

10. The paving machine of claim 6, further comprising a storage compartment located between said engine and said gravity feed hopper.

11. The paving machine of claim 6, wherein said discharge portion is inclined downwardly and rearwardly towards said vertically adjustable distributing auger mechanism so as to direct paving materials towards said top of said vertically adjustable auger mechanism without the aid of any external conveyors.

12. The paving machine of claim 6, wherein said gravity feed hopper has a capacity of about 12 tons of paving materials.

13. A method comprising:

providing a paving apparatus with a gravity feed hopper for holding paving materials, said gravity feed hopper having a capacity and including a discharge opening for discharging paving materials, said discharge opening having a first transverse length;

a storage portion for storing paving materials, said storage portion including i) an upper section for increasing the capacity of said hopper, said upper section having a relatively constant width and terminating at an open top; and ii) a lower generally frusto-conical section having an upper end of enlarged cross section and a lower end of reduced cross section, said upper end of enlarged cross section being connected to said upper section; and a discharge portion for directing paving materials from said storage portion to said discharge opening, said discharge portion having a second transverse length, a discharge portion upper end connected to said lower end of reduced cross section and a bottom end in which said discharge opening is formed;

a feeder gate for selectively closing said discharge opening, said feeder gate being mounted on said discharge portion of said gravity feed hopper; and a vertically adjustable distributing auger mechanism for distributing paving materials, said vertically adjustable distributing auger mechanism being supported by said lower generally frusto-conical section of said gravity feed hopper, said vertically adjustable distributing auger having a third transverse length, a top and a screw auger extending transversely across the paving apparatus, said screw auger being mounted on a slide which is raiseable and lowerable with respect to said gravity feed hopper, wherein i) said discharge opening is located between said storage portion and said vertically adjustable distributing auger mechanism and ii) said discharge portion is inclined downwardly and rearwardly towards said vertically adjustable distributing auger mechanism so as to direct paving materials towards said vertically adjustable auger mechanism without the aid of any external conveyors; then storing paving materials in said gravity feed hopper; and then feeding all of said stored paving materials by gravity through said discharge opening of said hopper towards said vertically adjustable distributing auger mechanism without employing any conveyors.

14. The method as defined in claim 13, wherein providing a paving apparatus includes providing a single operator's console located in a vicinity of said screed and further comprising controlling an entire operation of said paving apparatus from said single operator's console.

15. The method as defined in claim 13, wherein feeding substantially all of said stored paving materials by gravity through said discharge opening of said hopper includes feeding substantially all of said stored paving materials by gravity through said discharge opening of said hopper towards said top of said vertically adjustable distributing auger mechanism without employing any conveyors.

16. A paving apparatus, comprising:

a gravity feed hopper for holding paving materials, said gravity feed hopper having a capacity and including a discharge opening for discharging paving materials, said discharge opening having a first transverse length;

a storage portion for storing paving materials, said storage portion including i) an upper section for increasing the capacity of said hopper, said upper section having a relatively constant width and terminating at an open top; and ii) a lower generally frusto-conical section having an upper end of enlarged cross section and a lower end of reduced cross section, said upper end of enlarged cross section being connected to said upper section; and a discharge portion for directing paving materials from said storage portion to said discharge opening, said discharge portion having a second transverse length, a discharge portion upper end connected to said lower end of reduced cross section and a bottom end in which said discharge opening is formed;

a feeder gate for selectively closing said discharge opening, said feeder gate being mounted on said discharge portion of said gravity feed hopper; and a vertically adjustable distributing auger mechanism for distributing paving materials, said vertically adjustable distributing auger mechanism being mounted on said lower generally frusto-conical section of said gravity feed hopper, said vertically adjustable distributing auger having a third transverse length, a top and a hydrostatically driven screw auger extending transversely across the paving apparatus, said hydrostatically driven screw auger being mounted on a slide which is raiseable and lowerable with respect to said gravity feed hopper, wherein i) said discharge opening is located between said storage portion and said vertically adjustable distributing auger mechanism, ii) said discharge portion is inclined downwardly and rearwardly towards said vertically adjustable distributing auger mechanism so as to direct paving materials towards said vertically adjustable auger mechanism without the aid of any external conveyors, iii) said feeder gate is a clam shell gate that is opened and closed by a drive device, said drive device including a pair of hydraulic cylinders that are suspended from an outer wall of-said storage portion and connected to respective end portions of said clam shell gate and iv) said first transverse length is equal to both said second transverse length and said third transverse length.

17. A paving machine, comprising:

a portable chassis i) having a first end and a second end and ii) including a frame;

a front axle that is mounted on said portable chassis;

an engine mounted on said portable chassis between said first end and said front axle, wherein said front axle i) receives steering wheels and ii) is steered hydrostatically by said engine;

a rear axle that is mounted on said portable chassis between said front axle and said second end, said rear axle i) receiving driving wheels and ii) being powered hydrostatically by said engine;

a screed assembly mounted on said portable chassis, said screed assembly including i) a pair of transversely opposed tow arms that are mounted on said portable chassis between said front axle and said rear axle and ii) a heated vibratory screed that is pivotably suspended from said pair of transversely opposed tow arms;

a gravity feed hopper for holding paving materials, said gravity feed hopper i) being mounted on said portable chassis, ii) having a capacity and iii) including a discharge opening for discharging paving materials, said discharge opening having a first transverse length;

a storage portion for storing paving materials, said storage portion including an upper section for increasing the capacity of said hopper, said upper section having a relatively constant width and terminating at an open top; and a lower generally frusto-conical section having an upper end of enlarged cross section and a lower end of reduced cross section, said upper end of enlarged cross section being connected to said upper section; and a discharge portion for directing paving materials from said storage portion to said discharge opening, said discharge portion having a second transverse length, a discharge portion upper end connected to said lower end of reduced cross section and a bottom end in which said discharge opening is formed;

a single operator's console on which is located all manual controls required for operating said paving machine;

a feeder gate for selectively closing said discharge opening, said feeder gate being mounted on said discharge portion of said gravity feed hopper; and a vertically adjustable distributing auger mechanism for distributing paving materials, said vertically adjustable distributing auger mechanism being mounted on said lower generally frusto-conical section of said gravity feed hopper between said heated vibratory screed and said gravity feed hopper, said vertically adjustable distributing auger having a third transverse length, a top and a hydrostatically driven screw auger extending transversely across the paving apparatus, said hydrostatically driven screw auger being mounted on a slide which is raiseable and lowerable with respect to said frame, wherein i) said discharge opening is located between said storage portion and said vertically adjustable distributing auger mechanism, ii) said discharge portion is inclined downwardly and rearwardly towards said vertically adjustable distributing auger mechanism so as to direct paving materials towards said vertically adjustable auger mechanism without the aid of any external conveyors, iii) said feeder gate is a clam shell gate that is opened and closed by a drive device, said drive device including a pair of hydraulic cylinders that are suspended from an outer wall of said storage portion and connected to respective end portions of said clam shell gate.

* * * * *